US006443559B1

(12) United States Patent
Silverbrook

(10) Patent No.: US 6,443,559 B1
(45) Date of Patent: Sep. 3, 2002

(54) INK JET PRINTHEAD WHICH INCORPORATES MASS ACTUATED INK EJECTION MECHANISMS

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/866,786

(22) Filed: May 30, 2001

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

*Primary Examiner*—Raquel Yvette Gordon

(57) ABSTRACT

An ink jet print head has a plurality of nozzle arrangements. Each nozzle arrangement defines a nozzle chamber having an ink ejection port. Each nozzle arrangement has an ink ejection mechanism for ejecting ink from the nozzle chamber and out of the ink ejection port. Each ink ejection mechanism is repeatedly actuable by an actuator, at a desired frequency. The print head includes a plurality of de-activators which are operatively engageable with the ink ejection mechanisms and are selectively operable to de-activate the ink ejection mechanisms. The de-activators are connectable to a control system to control operation of the de-activators.

18 Claims, 3 Drawing Sheets

INK JET PRINTHEAD WHICH INCORPORATES MASS ACTUATED INK EJECTION MECHANISMS

FIELD OF THE INVENTION

This invention relates to an ink jet printhead which incorporates mass actuated ink ejection mechanisms. This invention also relates to a method of ejecting ink from a printhead.

BACKGROUND OF THE INVENTION

The Applicant has invented a page width printhead which is capable of generating text and images of a resolution as high as 1600 dpi on a printing medium.

The printheads are manufactured in accordance with a technique that is based on integrated circuit fabrication. An example of such a technique is that which is presently used for the fabrication of micro electromechanical systems.

These fabrication techniques allow the printhead to incorporate up to 84000 nozzle arrangements. The nozzle arrangements are electro-mechanically operated to achieve the ejection of ink. The reason for this is that presently used techniques such as those based on the heating of the ink to achieve ejection are simply not suitable when the nozzles are packed in such a high density. Applicant has found that the heat build up is excessive and would result in failure of the printhead.

The Applicant has addressed this problem by developing manufacturing techniques which are suitable for manufacturing, on a micro electromechanical scale, nozzle arrangements which are independently operable to eject ink. Applicant has filed a large number of patent applications to cover this technology. Applicant has found that electromechanical operation of the nozzle arrangements results in heat build up which is substantially less than the heat build up of other systems, such as those based on the heating of the ink and on piezoelectric movement.

It remains a goal, however, of the Applicant to achieve as little heat build up as possible. It will be appreciated that this could be achieved by reducing, even further, the amount of work required to achieve the displacement of the ink. Applicant has found that, by actuating ejection mechanisms remotely and en mass and then selectively controlling individual operation of the ejection mechanisms, a substantial reduction in energy requirements can be achieved.

SUMMARY OF THE INVENTION

According to a first aspect of the invention, there is provided an ink jet printhead which comprises at least one nozzle arrangement, the, or each, nozzle arrangement defining a nozzle chamber having an ink ejection port and the, or each, nozzle arrangement having an ink ejection mechanism for ejecting ink from the nozzle chamber and out of the ink ejection port, the, or each, ink ejection mechanism being repeatedly actuable by an actuator, at a desired frequency; and at least one deactivator which is operatively engageable with the, or each respective, ink ejection mechanism and which is selectively operable to deactivate the, or each respective, ink ejection mechanism, the deactivator being connectable to a control system to control operation of the deactivator.

According to a second aspect of the invention, there is provided an ink jet printhead which comprises a wafer substrate;

a plurality of nozzle arrangements formed at least partially from the wafer substrate in an integrated circuit fabrication process, each nozzle arrangement having two pairs of opposed walls that define a nozzle chamber, an ink ejection port and an ink displacement member which is pivotally connected to one of the nozzle chamber walls proximate an inlet of the nozzle chamber, each ink displacement member being repeatedly actuable on the application of a pulsed magnetic field to eject ink from the nozzle chamber through the ink ejection port, at a desired frequency; and a deactivator that is positioned in each nozzle arrangement and that is connected to drive circuitry, the deactivator being displaceable, on the application of an electrical current from the drive circuitry, between an operative position in which the deactivator engages the displacement member to inhibit actuation of the ink displacement member and an inoperative position in which the ink displacement member is free to pivot under influence of the pulsed magnetic field.

According to a third aspect of the invention, there is provided a method of ejecting ink from an ink jet printhead, the method comprising the steps of:

repeatedly actuating a plurality of ink ejection mechanisms positioned in each of a plurality of nozzle chambers defined by each of a plurality of nozzle arrangements that further each define an ink ejection port so that ink can be ejected from each of the injection ports at a desired frequency; and selectively deactivating the ink ejection mechanisms to control the ejection of ink from each ink ejection port.

The invention will now be described, by way of non-limiting example only, with reference to the accompanying drawings. The specific nature of the description which follows is not to be understood as limiting the scope of the above summary in any way.

DETAILED DESCRIPTION OF THE DRAWINGS

Figure 1:
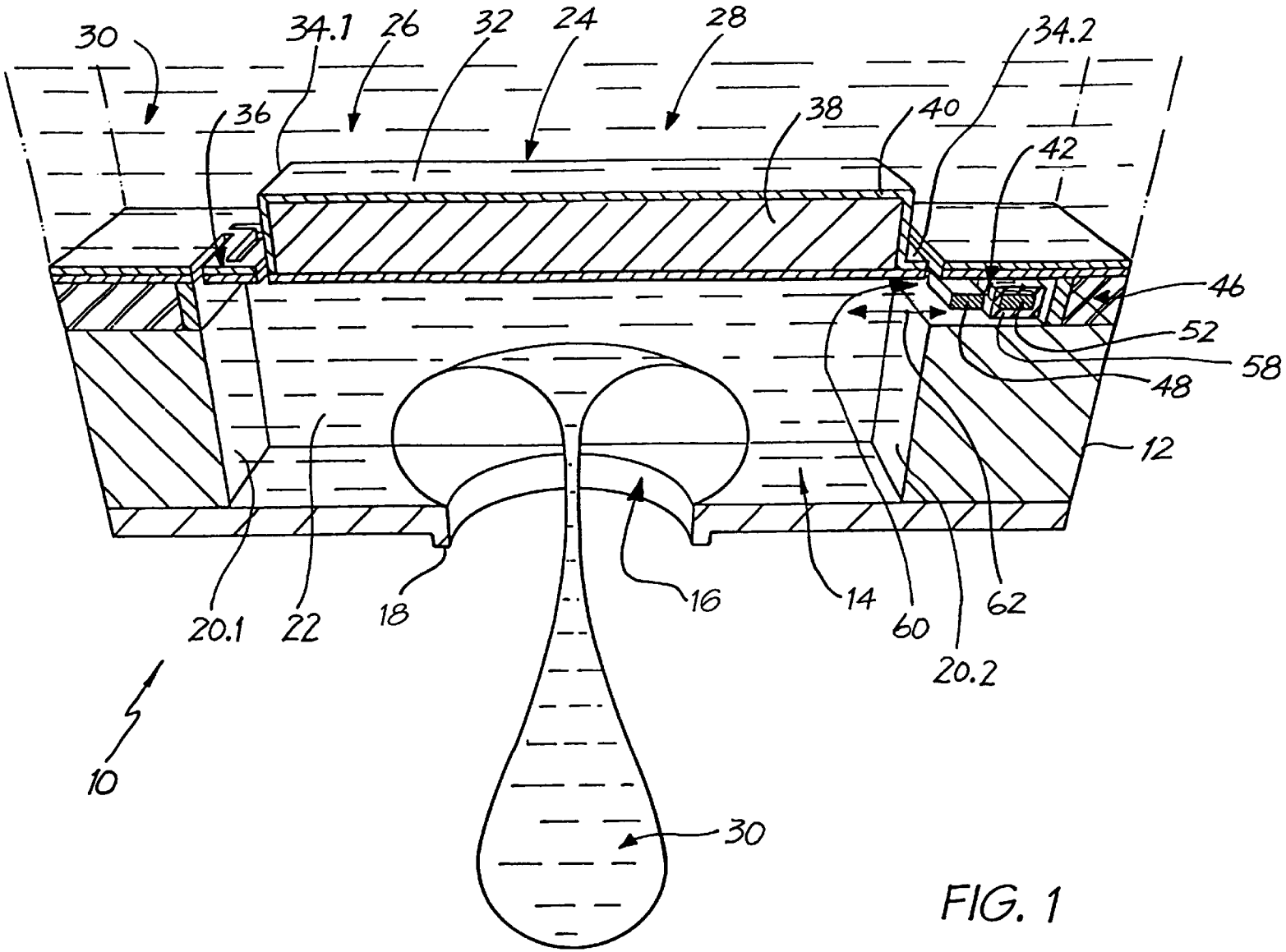
FIG. 1 shows a schematic, sectioned view of a nozzle arrangement of an ink jet printhead, in accordance with the invention.
Figure 2:
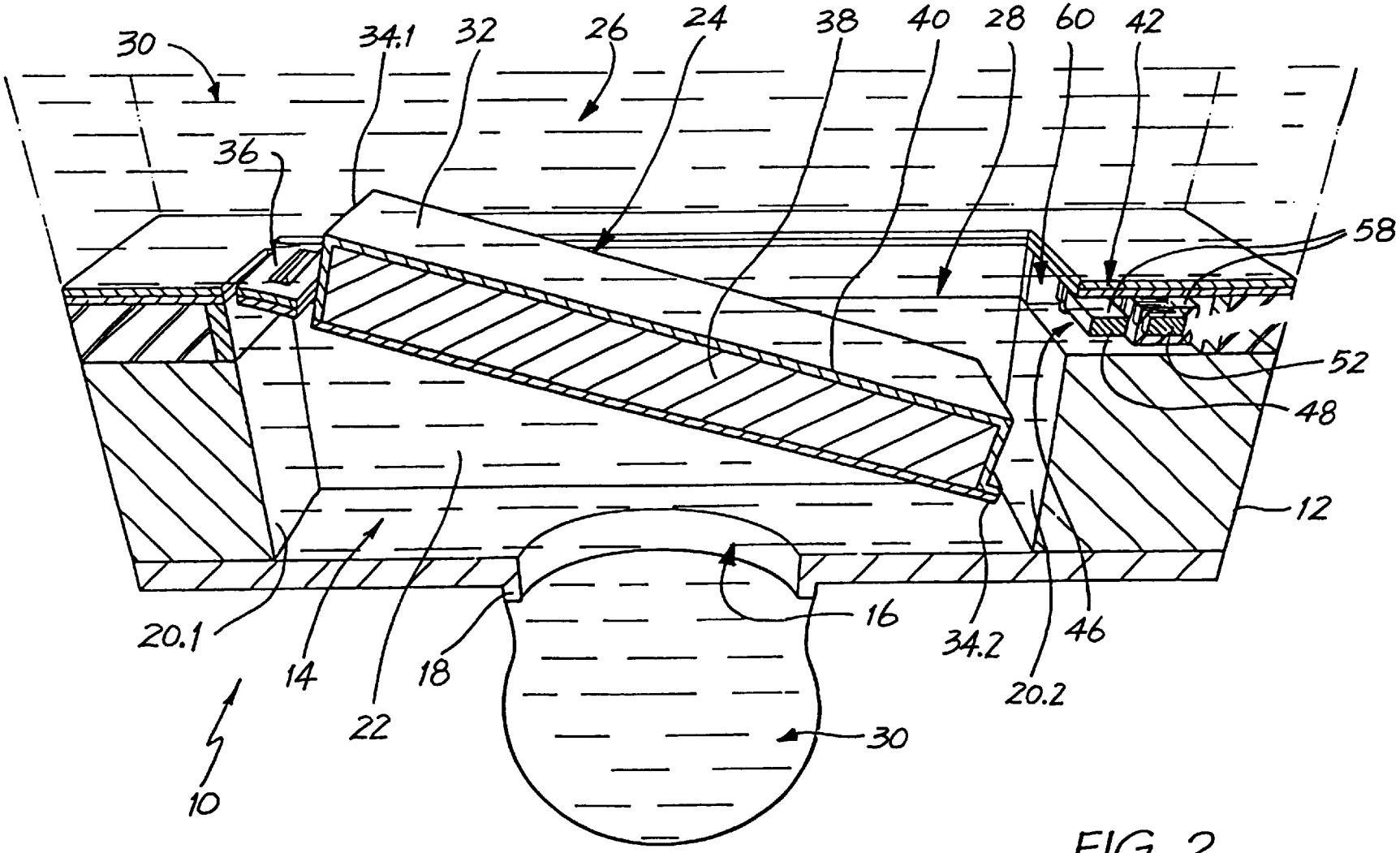
FIG. 2 shows a schematic, sectioned view of the nozzle arrangement with a deactivator of the printhead in an inoperative position.

In the drawings, reference numeral 10 generally indicates a nozzle arrangement of an ink jet printhead, in accordance with the invention. The printhead comprises a plurality of the nozzle arrangements 10. It follows that, for ease of description, a single nozzle arrangement is described below with reference to the drawings. The printhead is in the form of a page width printhead. It follows that those of ordinary skill in the field of printhead manufacture will appreciate that the printhead comprises a large number of the nozzle arrangements 10.

In this particular example, a wafer substrate 12 is provided with the nozzle arrangements 10 formed in and partially of the substrate 12.

The nozzle arrangement 10 includes a nozzle chamber 14 that is defined in the substrate 12. An ink ejection port 16 is also defined in the wafer substrate 12 to be in fluid communication with the nozzle chamber 14. A nozzle rim 18 is defined about the ink ejection port 16.

The nozzle chamber 14 has a substantially rectangular cross section with a pair of opposed minor walls 20 and a pair of opposed major walls 22. An inlet 24 is defined in the substrate 12 and is positioned opposite the ink ejection port 16. The nozzle chamber 14 is in fluid communication with an ink reservoir 26, via the inlet 24.

The nozzle arrangement 10 includes an ink ejection mechanism 28 for ejecting ink 30 from the nozzle chamber 14 out of the ink ejection port 16. The ink ejection mechanism 28 includes an ink ejection member in the form of a paddle 32. The paddle 32 is pivotally connected to one of the minor walls 20.1 via a flexible connector 36 fixed to one end 34.1 of the paddle 32.

The paddle 32 is dimensioned to correspond generally with the cross sectional dimensions of the nozzle chamber 14. It follows that, when actuated, the paddle 32 can move into the nozzle chamber 14 to displace the ink 30 from the nozzle chamber 14, thereby ejecting the ink 30 out of the ink ejection port 16.

The paddle 32 is configured to be actuated upon the application of a magnetic field to the paddle 32. Thus, the paddle 32 has a magnetic core 38. In particular, the paddle 32 is responsive to a pulsed magnetic field, so that, when such a field is applied to the paddle 32, ink drops are ejected from the ink ejection port 16 at a frequency corresponding to that of the pulsed magnetic field. The magnetic core 38 is coated with a layer of passivation material 40.

Figure 3:
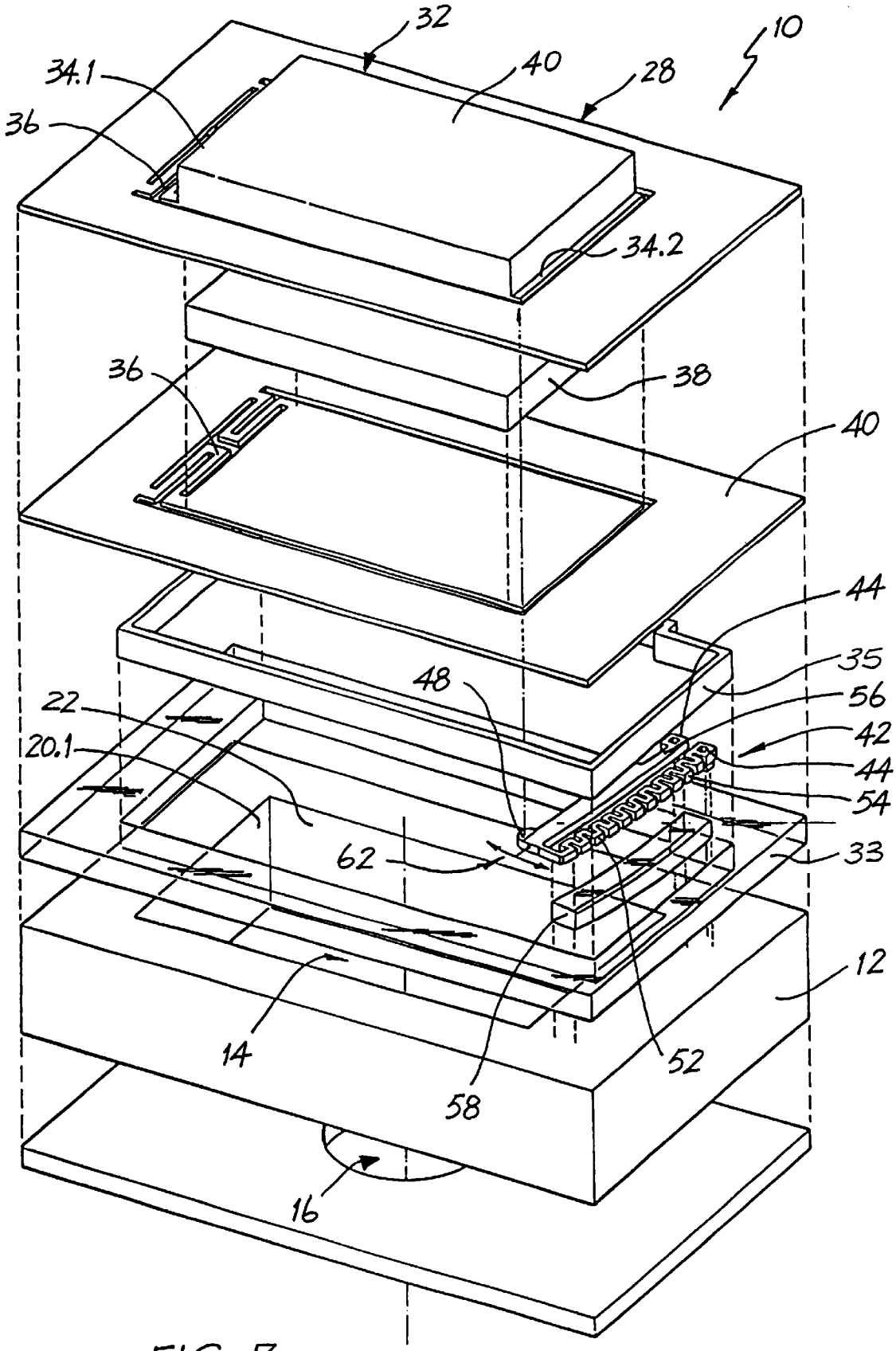
FIG. 3 shows a schematic, exploded view of the nozzle arrangement.

The nozzle arrangement 10 includes a deactivator in the form of a detent mechanism 42 which is positioned in an opposed minor wall 20.2. The detent mechanism 42 is connected at 44 to electrical drive circuitry indicated generally at 33 in FIG. 3. The drive circuitry 33 provides the detent mechanism 42 with operative energy when required.

A recess 46 is defined in the minor wall 20.2 in a position approximately directly opposed to the point at which the flexible connector 36 is attached to the minor wall 20.1. The detent mechanism 42 is positioned in the recess 46 and includes a stop formation 48 which extends into the nozzle chamber 14 when the detent mechanism 42 is in an operative condition, to bear against a free end 34.2 of the paddle 32, thereby inhibiting movement of the paddle 32 into the nozzle chamber 14 so that the ink 30 is not ejected from the nozzle chamber 14.

The detent mechanism 42 includes a resistive circuit 52 which is connected to the drive circuitry 33 so that the detent mechanism 42 can be thermally actuated by an electrical current passing through the resistive circuit 52. The resistive circuit 52 comprises two parts 54 and 56. The first part 54 has a higher resistance than the second part 56. In particular, the first part 54 has a serpentine construction and has a smaller cross sectional area than the second part 56. The second part 56 has a substantially linear configuration.

The circuit 52 is positioned in a displaceable element 58 of thermal expansion material. In this example, the thermal expansion material is polytetrafluoroethylene (PTFE). PTFE has a coefficient of thermal expansion which is such that the PTFE can do work as a result of expansion upon heating of the PTFE. The parts 54 and 56 of the resistive circuit 52 are positioned in the PTFE so that the PTFE is unevenly heated when an electrical current passes through the circuit 52. In particular, the parts 54 and 56 are positioned in a side-by side manner with the second part 56 positioned between an opening 60 of the recess 46 and the first part 54. It follows that, upon the uneven heating, a portion of the PTFE distal from the opening 60 expands substantially more than a portion proximate the opening 60, causing the element 58 to bend towards the opening 60. The stop formation 48 is defined by the PTFE and is dimensioned to extend into the nozzle chamber 14 when the element 58 bends in the manner described above. PTFE is inherently resilient. It follows that, upon cooling of the PTFE, the element 58 returns to its inoperative position.

The element 58 is arranged laterally with respect to the wall 20.2, with one end anchored to the wall 20.2 within the recess 46. Movement of the element 58 is indicated by a double headed arrow 62.

The serpentine configuration of the first part 54 of the resistive circuit is advantageous in that it permits expansion of the first part 54 when the PTFE about the first part 54 expands. This serves to inhibit separation of the first part 54 from the PTFE.

It will be appreciated that, in use, the PTFE about the part 56 is in contact with the ink 30 to a greater degree than the part 54. This enhances the temperature difference in the PTFE and thus movement of the element 58 during operation.

The printhead is the product of a fabrication process using integrated circuit fabrication techniques. In this particular example, the printhead is the product of a process which uses fabrication techniques suited to the manufacture of micro electromechanical systems. As can be seen in FIG. 4, the nozzle arrangement 10 is a layered structure. This facilitates fabrication of the printhead in this manner. The manner in which the printhead is manufactured is covered by the above cross referenced material and is therefore not described in any detail in this specification.

As set out above, the electrical drive circuitry is connected to the resistive circuit. It will thus be appreciated that the control system can be suitably configured to control operation of the drive circuitry and thus the resistive circuit.

It will be appreciated by those of ordinary skill in the art of printhead manufacture that the amount of energy required to achieve independent displacement of the paddle 32 is substantially more than that required to achieve independent displacement of the detent mechanism 42. Further, the application of a mass actuating signal to all the paddles 32 simultaneously requires a suitably low level of energy per paddle 32. This is particularly so since this form of printhead can have up to 84 000 nozzle arrangements. It follows that the Applicant believes that the use of the mass actuated paddles 32 together with the detent mechanisms 42 results in a substantial saving of energy. As set out in the background, this is an important advantage of printhead.

I claim:

1. An ink jet printhead which comprises at least one nozzle arrangement, the, or each, nozzle arrangement defining a nozzle chamber having an ink ejection port and the, or each, nozzle arrangement having an ink ejection mechanism for ejecting ink from the nozzle chamber and out of the ink ejection port, the, or each, ink ejection mechanism being repeatedly actuable by an actuator, at a desired frequency; and at least one deactivator which is operatively engageable with the, or each respective, ink ejection mechanism and which is selectively operable to deactivate the, or each respective, ink ejection mechanism, the deactivator being connectable to a control system to control operation of the deactivator.

2. An ink jet printhead as claimed in claim 1, which comprises a plurality of nozzle arrangements incorporated on a chip that is the product of an integrated circuit fabrication technique.

3. An ink jet printhead as claimed in claim 2, in which the nozzle arrangements and the deactivators are micro electromechanical components.

4. An ink jet printhead as claimed in claim 2, in which the chip is dimensioned to span a printing medium of a predetermined width, so that the printhead defines a pagewidth printhead.

5. An ink jet printhead as claimed in claim 2, in which each ink ejection mechanism includes an ink displacement member which is positioned in each respective nozzle chamber, each ink displacement member being displaceable in its respective nozzle chamber to eject ink from the ink ejection port.

6. An ink jet printhead as claimed in claim 5, in which the deactivators are in the form of detent mechanisms which are positioned on the nozzle arrangements and are displaceable between an operative position in which the detent mechanisms engage the respective ink displacement members, and an inoperative position in which the ink displacement members are free to move, the detent mechanisms being connectable to suitable drive circuitry to permit selective operation of the detent mechanisms.

7. An ink jet printhead as claimed in claim 6, in which the detent mechanisms each include a resistive circuit which is connected to the drive circuitry so that the detent mechanisms can be thermally actuated by an electrical current passing through the resistive circuit.

8. An ink jet printhead as claimed in claim 7, in which the resistive circuit comprises two parts, a first part having a higher resistance than a second part, with the parts being positioned in a displaceable element of expansion material, having a coefficient of thermal expansion which is such that, when heated, the expansion material expands to a degree sufficient to perform work, the parts being positioned such that the displacement material is unevenly heated as a result of the different resistivities of the two parts resulting in displacement of the displaceable element.

9. An ink jet printhead as claimed in claim 8, in which each nozzle arrangement includes a pair of opposed walls that define the nozzle chamber, the ink displacement member being pivotally mounted on one of the walls proximate an inlet of the nozzle chamber to extend to an opposed wall, the opposed wall defining a recess in which the detent mechanism is positioned, and the ink displacement member being dimensioned so that an end of the ink displacement member passes across the recess when the ink displacement member is actuated, the detent mechanism having a stop formation that extends into the chamber when the detent mechanism is in its operative position so that the end of the ink displacement member bears against the stop formation to inhibit movement of the ink displacement member past the recess.

10. An ink jet printhead as claimed in claim 9, in which one end of the displaceable element is fixed to said opposed wall, in the recess, the stop formation being arranged on the displaceable element and the displaceable element being configured so that, when unevenly heated, the displaceable element bends to an extent sufficient to ensure that the stop formation extends into the chamber to obstruct movement of the ink displacement member.

11. An ink jet printhead as claimed in claim 10, in which said first part of the resistive circuit has a smaller cross sectional area than said second part and has a serpentine configuration, while the second part has a substantially linear configuration, the parts being positioned in a side-by-side manner with the second part positioned between the first part and an opening of the recess.

12. An ink jet printhead as claimed in claim 9, in which each ink displacement member has a core of a magnetic material and a coating of a surface passivation material.

13. An ink jet printhead as claimed in claim 9, in which each ink displacement member has a flexible connector for pivotally connecting the ink displacement member to said one of the walls defining the nozzle chamber.

14. An ink jet printhead as claimed in claim 2, in which the ink ejection mechanisms are actuable by a pulsed magnetic field generated by a magnetic pulse generator.

15. An ink jet printhead as claimed in claim 1, in which each nozzle arrangement and the deactivator are of a layered structure to facilitate manufacture by techniques commonly used for the construction of micro electromechanical systems.

16. An ink jet printing device which includes an ink jet printhead as claimed in claim 1.

17. An ink jet printhead which comprises a wafer substrate;

a plurality of nozzle arrangements formed from the wafer substrate in an integrated circuit fabrication process, each nozzle arrangement having two pairs of opposed walls that define a nozzle chamber, an ink ejection port and an ink displacement member which is pivotally connected to one of the nozzle chamber walls proximate an inlet of the nozzle chamber, each ink displacement member being repeatedly actuable on the application of a pulsed magnetic field to eject ink from the nozzle chamber through the ink ejection port, at a desired frequency; and a deactivator that is positioned in each nozzle arrangement and that is connected to drive circuitry, the deactivator being displaceable on the application of an electrical current from the drive circuitry between an operative position in which the deactivator engages the ink displacement member to inhibit actuation of the ink displacement member and an inoperative position in which the ink displacement member is free to pivot under influence of the pulsed magnetic field.

18. A method of ejecting ink from an ink jet printhead, the method comprising the steps of:

repeatedly actuating a plurality of ink ejection mechanisms positioned in a each of a plurality of nozzle chambers defined by each of a plurality of nozzle arrangements that further each define an ink ejection port so that ink can be ejected from each of the injection ports at a desired frequency; and selectively deactivating the ink ejection mechanisms to control the ejection of ink from each ink ejection port.

* * * * *